United States Patent [19]

Radaelli et al.

[11] Patent Number: 4,711,400

[45] Date of Patent: Dec. 8, 1987

[54] ELECTROMAGNETIC INJECTOR FOR AN I.C. ENGINE

[75] Inventors: Dario Radaelli, Legnano; Walter Giraudi, Milan, both of Italy

[73] Assignee: Alfa Romeo Auto S.p.A., Naples, Italy

[21] Appl. No.: 826,325

[22] Filed: Feb. 5, 1986

[30] Foreign Application Priority Data

Feb. 7, 1985 [IT] Italy ..... 19421 A/85

[51] Int. Cl.[4] ..... B05B 1/30

[52] U.S. Cl. ..... 239/585

[58] Field of Search ..... 239/585; 251/129.21, 251/129.15, 129.16

[56] References Cited

U.S. PATENT DOCUMENTS 3,967,597 7/1976 Schlagmüller et al. ..... 239/585 X
4,339,082 7/1982 Radaelli et al. ..... 239/585
4,342,427 8/1982 Gray ..... 239/585
4,351,480 9/1982 Masaki et al. ..... 239/585
4,365,747 12/1982 Knapp et al. ..... 239/585 X
4,575,009 3/1986 Giraudi ..... 239/585

FOREIGN PATENT DOCUMENTS 2039993 8/1980 United Kingdom ..... 239/585

*Primary Examiner*—Andres Kashnikow
*Assistant Examiner*—Daniel R. Edelbrock
*Attorney, Agent, or Firm*—Charles E. Brown; Charles A. Brown

[57] ABSTRACT

The electroinjector according to the invention is provided with a small tubular armature, whose bottom wall is constituted by a plate, of material which resists deformation due to impact and directly fastened on to the cylindrical side wall of the same armature, with which a shutter of an injection nozzle is fixedly secured.

8 Claims, 6 Drawing Figures

Fig.2
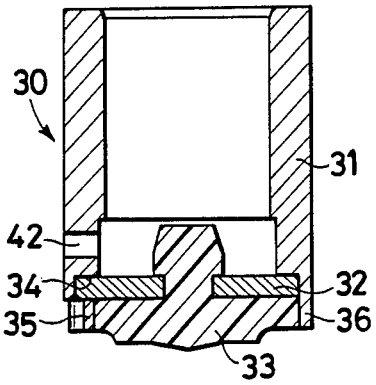
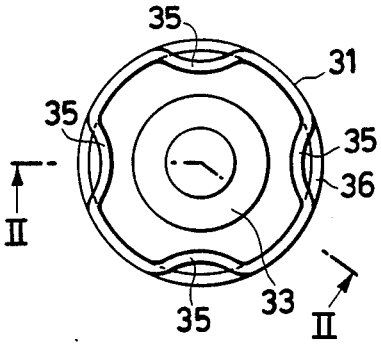
Fig.3
Fig.4
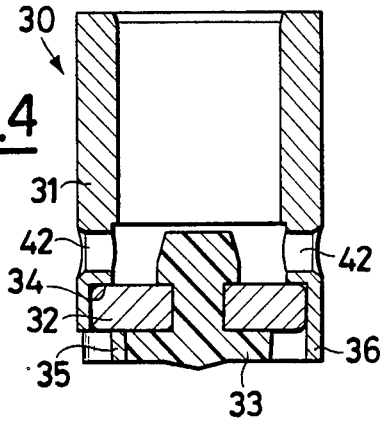
Fig.5
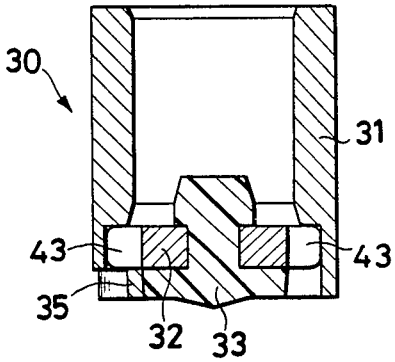
Fig.6
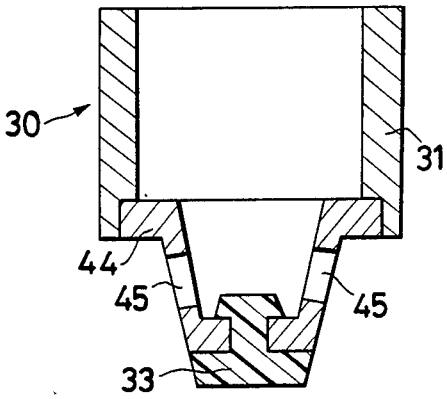

ELECTROMAGNETIC INJECTOR FOR AN I.C. ENGINE

The present invention relates to an electroinjector for the injection of fuel in an I.C. engine, and relates in particular to an electroinjector provided with a small glass-shaped armature, with the bottom wall being made, at least partly, with sealing material, to act as the shutter of a fuel injection nozzle.

Electroinjectors of this type are already known, and in the U.S. Pat. No. 4.339.082 granted on 13.7.82 to the same Applicant. One of the electroinjectors is disclosed wherein the bottom wall of the small armature, made in plastic material, is fastened to the cylindrical side wall, made of ferromagnetic material, by grafting on to the edge of this latter.

An electroinjector of similar type is also disclosed in the U.S. patent application No. 469.708 of 25.2.1983, now U.S. Pat. No. 4,575,009 granted Mar. 11, 1986. In this case, the bottom wall of plastic material is fastened to the cylindrical side wall together with a washer of impact resistant material, always by grafting of the edge of the same side wall.

This link between a soft material, as the one of the seal, and a rigid material, as that of the side wall of the small armature, can becomes critical with time, because of the repeated impacts to which the bottom wall of the small armature, which at each injection cycle goes to beat at least against the injection nozzle, is subjected;

As a consequence, when the electroinjector has accumulated a fairly high number of injection cycles, yieldings and loosenings may occur of the grip between side wall and bottom wall; and that worsens its operation, even if does not arrive to compromise its useful life.

In fact, electroinjectors drift, even sensibly, because, due to the variations of stroke of the small armature, the deliveries of fuel deviate to a fairly high extent from the tolerances allowed relatively to calibration values.

In order to overcome these problems, and improve the behaviour over time of the previously disclosed electroinjectors, according to the present invention an injector has been provided for an I.C. engine, constituted by a core of ferromagnetic material, by a coil surrounding the core, by an injection nozzle, by a small tubular movable armature, positioned between the core and the injection nozzle, coaxial with both of them, and having the function of shutter of the same injection nozzle, by a return spring pushing the small armature against said injection nozzle, by a tube, partly inserted inside the core, acting as inner guide for the small armature, by a duct for delivering the fuel towards the injection nozzle, by an outer shell closing the magnetic circuit together with the core and the small armature, the electronjector being characterized in that the small armature is provided with a bottom wall constituted by a plate, of impact resistant material, and directly fastened on to the cylindrical side wall of the same small armature, with which a shutter made of sealing material is fixedly secured.

Always according to the invention, accomplishing the said small armature is provided by fastening directly on to its cylindrical side wall, as the bottom wall, a plate if impact resistant material, with which a shutter made of sealing material is fixedly secured.

Preferably, the plate is constrained to the cyclindrical side wall of the small armature by means of at least two radial notches provided in the same cylindrical wall, but the plate could also be welded to the cylindrical side wall.

An insert of sealing material, acting as shutter, is fastened on to the plate by moulding, before or after the constraining of the same plate to the cylindrical side wall of the armature.

Characteristics and advantages of the invention shall be now illustrated with reference to attached FIGS. 1–6, wherein to exemplifying, not limitative, purposes, preferred embodiments of the same invention are shown.

FIG. 2 shows a detail of the electroinjector of FIG. 1, in section along the path plane II—II of FIG. 3;

FIG. 3 is a bottom view of FIG. 2;

FIGS. 4, 5 and 6 show variants of the detail shown in FIG. 2.

Figure 1:
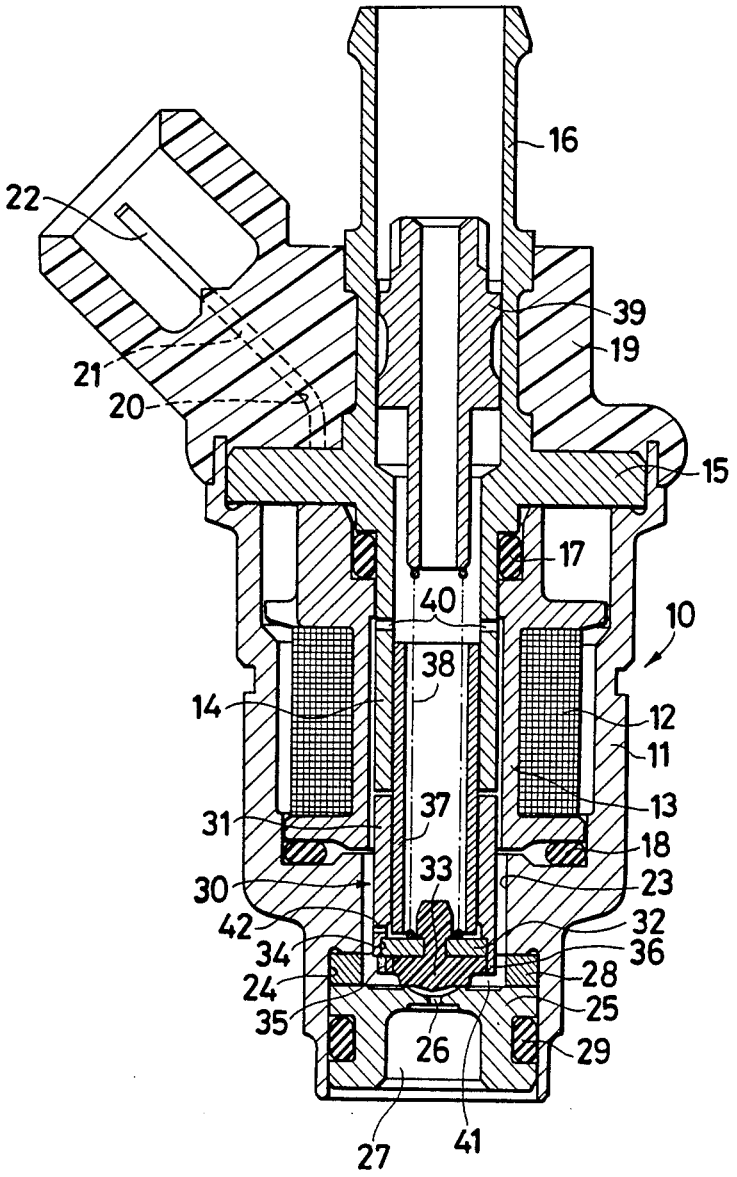
FIG. 1 is a sectional view of an electroinjector according to the invention.

In FIG. 1 with 10 an electroinjector is generally indicated, comprising an outer shell 11, a coil 12, wound on a bobbin 13, a core of ferromagnetic material 14, a polar expansion member 15, a tube 16, which is to be connected to a fuel supply duct.

Between bobbin 13 and core 14 a sealing ring 17 is positioned, and also between bobbin 13 and shell 11 a sealing ring 18 is provided.

With 19 a cap of plastic material is indicated, which caps is put on the tube 16, on the polar expansion member 15 and on the upper portion of the shell 11, and is provided with a small channel 20, from which the conductor 21 of the coil 12 protrudes, to connect to the connector 22 and receive excitation current from an injection control device, not shown.

In its bottom portion, the shell 11 is provided with an inner polar expansion chamber, of annular shape, indicated with 23, and beneath this a tubular nose 24, which is inserted inside the corresponding housing of the intake duct, not shown, of an I.C. engine. Inside the tubular nose 24 a ring 25 is placed, within which a fuel injection nozzle 26 is provided, as well as a hollow 27, into which the jet of fuel supplied from the same nozzle 26 sprinkles.

The ring 25 is inserted in the tubular nose 24 with the interposition of a spacer 28 and of a sealing ring 29.

A small tubular movable armature 30 is positioned between the core 14 and the nozzle 26; the armature 30 is provided with a cylindrical side wall 31, made of material permeable to magnetic induction flux, e.g., an iron-nickel alloy, such as Permenorm 5000, and with an end wall which, according to the invention, is constituted by a washer or plate 32 of a material resistant to deformation due to impact, e.g., steel, such as X10CrNi1809, to which an insert 33 of seal forming material, such as a plastic material, as Delrin, acting as the shutter of injection nozzle 26 is fixedly secured.

The details of small armature 30 can be seen in FIGS. 2 and 3.

The washer 32 is housed in a shoulder or lower seat forming portion 34 of the wall 31, with which it is fixedly secured by means of four radial projections 35, obtained by means of a process of radial notching of a collar 36, of reduced thickness, of wall 31. The insert 33 of plastic material is fastened on to the washer 32 by die riveting, either after the washer 32 has been constrained relative to the cylindrical wall, as in the embodiment of FIGS. 1, 2, 3, or before being constrained, as in the embodiments of FIGS. 4, 5, 6.

As an alternative, the washer 32 could be fastened to the wall 31 by means of welding.

Inside the core 14 a tubular element 37 is inserted with an interference fit, internally guiding the small armature 30, keeping it coaxial with the core 14 and the nozzle 26.

The distance between the lower annular wall of the element 37 and the upper wall of the washer 32, when the electroinjector is vertically disposed, is equal to the stroke of the small armature 30.

Inside the tubular element 37 a pre-loaded return spring, indicated with 38, is provided, which spring pushes the small armature 30 downwards, to close the nozzle 26. The pre-loading of the spring 38 is obtained by means of a bored adjusting pin, indicated with 39, inserted inside the fuel supply tube 16. The pressurized fuel arriving at the tube 16 streams inside the tubular element 37, and through bores 40 of the core 14 it enters a chamber 41 which feeds the nozzle 26, when the small armature 30 and the insert or shutter 33 move upwards.

The cylindrical wall 31 of the small armature 30 is provided with breather holes, as in 42, which are provided to avoid the fuel to be pumped inside the small armature 30.

The command signals for the feeding of the electroinjector 10 arrive cyclically to the coil 12 as current pulses, substantially of square wave type, emitted by an injection delivery and timing control device. As an example, each current pulse can be constituted by an initial peak followed by a step of reduced value.

The current pulses, whose duration is variable as a function of the amount of gasoline required by the engine under the different operating conditions, cause the excitation of the coil 12, generating a magnetomotor force and a magnetic induction flux in the loop comprising the shell 11, the polar expansions 15 and 23, the small armature 30, the core 14. Due to the effect of the induced polarization, the small armature 30 moves upwards against the action of the spring 38, effecting a stroke which is limited by the shoulder of the washer 32 against the lower wall of the tubular element 37; the small armature 30 remains lifted during the duration of the current pulse, allowing a jet of fuel under pressure to be fed by the nozzle 26 into the hollow 27.

At the end of the current pulse, the small armature 30 moves downwards, under the action of the spring 38, and closes the nozzle 26 interrupting the fuel feeding. With the small armature 30 as previously disclosed, both the manufacturing process and the constancy of behaviour over time of electroinjector 10 result particularly optimized.

In particular, the inner cylindrical surface of the wall 31, which slides on the guide 37, can be machined with simpleness, to obtain tha desired finishing degree, in that it is formed by a length of tube, with which the washer 32 is then assembled.

Another advantage of the solution as proposed is represented by the fact that the direct link between the washer 32 and the cylindrical wall 31 results quick to be effected and very stable, also in the case in which it is carried out by radial notching operations, which present the further advantage of a minimum cost.

The link between washer 32 and wall 31 does not suffer alterations, even after a very high number of operating cycles, notwithstanding the repeated impacts the washer undergoes, at the opening and at the closure of the nozzle 26, when it goes to beat respectively against the tube 37 and the nozzle 26.

Moreover, as previously stated, the insert 33, which constitutes the shutter of the electroinjector, can be riveted on the washer 32, before fastening the washer to the wall 31 (FIGS. 4, 5, 6), or after the fastening or welding operation (FIGS. 1, 2, 3); this improves the stability of the link between the washer and the cylindrical wall.

In the variant of FIG. 5, the ports 43 being the washer 32 is provided with ports 43 for the vent of fuel, provided in lieu of of holes 42, provided in the wall 31 of the embodiment of FIG. 1.

In the small armature shown in FIG. 6, the end wall is constituted by a plate 44 of frustoconical shape, which is welded, e.g., by laser, to the cylindrical wall 31 and is provided with ports 45 for the passage of fuel.

Of course, the assembling between cylindrical wall 31 and plate 44 could be carried out by any other suitable system, such as the constraining by notches, as in embodiment of FIG. 1.

We claim:

1. Electroinjector for an I.C. engine, said electroinjector comprising a core of ferromagnetic material, a coil surrounding the core, an injection nozzle, a small tubular movable armature positioned between the core and the injection nozzle and being coaxial with both said core and said injection nozzle, a return spring pushing the small armature towards said injection nozzle, a tube, partly inserted inside the core, acting as inner guide for the small armature, a duct for delivering the fuel towards the injection nozzle, an outer shell closing the magnetic circuit together with the core and the small armature, and there being a plate and a shutter, the electroinjector being characterized in that the small armature is provided with an end wall constituted by said plate with said plate being formed of material resistant to deformation due to impact, and directly fastened on to the cylindrical side wall of the small armature independently of said shutter, and said shutter being made of sealing material and fixedly secured directly to said plate separate and apart from said armature.

2. Electroinjector according to claim 1, characterized in that said plate is constrained to the cylindrical side wall of the small armature by means of at least two radial projections provided on the cylindrical wall by notching said cylindrical wall radially inwardly beneath said plate.

3. Electroinjector according to claim 2, characterized in that an end of the cylindrical side wall of the small armature disposed adjacent said injection nozzle is provided with a collar of reduced thickness, ending with an annular shoulder against which said plate is housed.

4. Electroinjector according to claim 1, characterized in that said plate is shaped in washer form.

5. Electroinjector according to claim 4, characterized in that said shutter is fastened to said washer by riveting.

6. Electroinjector according to claim 1, characterized in that said plate has a frustoconical shape.

7. Electroinjector according to claim 6, characterized in that said shutter is fastened on to said plate of frustoconical shape by riveting.

8. Electroinjector according to claim 1, characterized in that said shutter is fastened on to said plate by riveting.

* * * * *